US005492024A

United States Patent [19]

Siner

[11] Patent Number: 5,492,024

[45] Date of Patent: Feb. 20, 1996

[54] SERVO-WHEEL FOR USE WITH POWERED MODEL CRAFT

[76] Inventor: Irwin H. Siner, 201 S. Third St., Coopersburg, Pa. 18036

[21] Appl. No.: 199,535

[22] Filed: Feb. 22, 1994

[51] Int. Cl.[6] ..... B64C 13/30; G05G 1/10

[52] U.S. Cl. ..... 74/89.22; 74/96; 74/522; 244/75 R; 244/190; 244/17.19; 403/359; 446/36

[58] Field of Search ..... 74/522, 525, 96, 74/105, 434, 451, 89.22; 403/359, 298, 260; 446/31, 32, 36; 244/75 R, 189, 190, 221, 230, 17.19; 416/134 A

[56] References Cited

U.S. PATENT DOCUMENTS

| | | | |
|---|---|---|---|
| 2,035,525 | 3/1936 | Bloss | 74/522 |
| 3,699,708 | 10/1972 | Mabuchi | 446/57 |
| 3,742,656 | 7/1973 | Amos | 403/359 |
| 3,791,067 | 2/1974 | Guttman | 46/75 |
| 4,762,294 | 8/1988 | Udo | 244/75 R |
| 5,046,979 | 9/1991 | Ragan et al. | 446/57 |
| 5,078,638 | 1/1992 | Molina | 446/57 |

*Primary Examiner*—Rodney H. Bonck
*Assistant Examiner*—Troy Grabow
*Attorney, Agent, or Firm*—James R. Bell

[57] ABSTRACT

A servo-wheel for use in a control system for model craft having a servo-motor and movable control members. The servo-wheel is a rigid disc having opposed planar surfaces. A hub is at the geometric center of the disc and includes a bore extending through the disc. A raised portion protrudes from one of the planar surfaces and forms a first part of the hub. The raised portion also defines a first part of the bore having an inner circumferential surface of a first diameter. A keyed receiver is formed in the inner circumferential surface of the raised portion. An insert is mounted in the disc to form a second part of the hub. The insert defines a second portion of the bore and has an inner circumferential surface of a second diameter, less than the first diameter. A keyed driver is received by the keyed receiver. The keyed driver is rotatably connected to the servo-motor at one end and attached to the servo-wheel hub at the other end, so that the servo-wheel is rotated by the servo-motor. Control rods or a cable interconnect the servo-wheel and the control members so that movement of the servo-wheel is transmitted to the control members.

17 Claims, 5 Drawing Sheets

SERVO-WHEEL FOR USE WITH POWERED MODEL CRAFT

FIELD OF THE INVENTION

This invention relates generally to powered model craft such as airplanes, helicopters, boats, cars and the like, and more particularly to a wheel coupled to a servo-motor for transferring control motion from the servo-motor to control members of the craft.

BACKGROUND OF THE INVENTION

Hobbyists who enjoy operating powered models realize the importance of maintaining control over the models during operation. Control may be accomplished by a cable directly connected to the model, or by radio signals transmitted from a remote control transmitter, usually hand-held, to a receiver mounted in the model.

A control failure may be due to operator error, or due to a part failure, but in either case, expensive damage to the model craft may result. Control failures due to a part failure can be overcome by improving the reliability of parts when the causes of failure become apparent.

The use of a wheel or arm member coupled to a servo-motor for transferring control motion from the servo-motor to control members is well known. Present known servo-wheels are formed of a synthetic material such as a plastic or the like. These wheels are coupled to either cables or metal control rods and also to servo-output shafts.

During controlled maneuvers these wheels are subjected to high stresses, often suddenly applied, and often rapidly repeated in reversed directions. As a result, a great deal of flex and wear, and sometimes failure, is imposed on the plastic part. This wear is cumulative, and over time the plastic wheel to metal control rod coupling becomes loose, creating slop or lost motion between the output shaft of the servo-motor and the control rods connected to the servo-wheel.

One prime area of such wear is at the spline connection between the present plastic wheel and the plastic servo-output shaft. Under certain conditions the plastic splines will spread, causing teeth to skip and misalign. Sometimes the splines of the servo-output shaft are stripped by the plastic splines of the wheel.

Another prime area of such wear is in the linkage connection between the control rods, and their respective mounting holes formed in the plastic servo-wheel. Eventually, the mounting holes in the plastic part wear and spread causing a loose fit or connection with the control rods. As a result, slop or lost motion occurs at the connection between the wheel and the control rod.

A further prime area of concern is the flexing of the plastic servo-wheel or arm member as a result of the high, sudden stresses imposed thereon. These stresses can cause distortion and eventual failure.

The foregoing illustrates limitations of the known prior art. Thus, it is apparent that it would be advantageous to provide an alternative directed to overcoming one or more of the limitations as set forth above. Accordingly, a suitable alternative is provided including features and benefits more fully disclosed hereinafter.

SUMMARY OF THE INVENTION

In one aspect of the present invention, this is accomplished by providing a servo-wheel having a rigid disc-shaped body with first and second opposed planar surfaces and an outer circumferential surface. A hub is at the geometric center of the body and includes a through-bore extending through the body. A raised portion protrudes from the first planar surface and forms a first part of the hub. The raised portion defines a first portion of the through-bore and includes an inner circumferential surface having a first diameter. A keyed receiver is formed in the inner circumferential surface of the raised portion. An insert is mounted in the body and forms a second part of the hub. The insert also defines a second portion of the through-bore having an inner circumferential surface of a second diameter, less than the first diameter.

In another aspect of this invention, the servo-wheel is provided for use in a control system for model craft having a servo-motor and movable control members. A keyed driver is matingly received by the keyed receiver. The keyed driver is rotatably connected to the servo-motor at one end and attached to the servo-wheel hub at the other end so that the servo-motor can rotatably move the servo-wheel. Means are provided for interconnecting the servo-wheel and the control members so that movement of the servo-wheel is transmitted to the control members.

In still another aspect of this invention, a method of forming a servo-wheel includes the steps of cutting a disc from a section of bar stock, the disc having first and second opposed planar surfaces; machining a raised portion at the geometric center of the first planar surface; boring a bore through the disc, the bore extending through the raised portion and having an inner circumferential surface of a first diameter; forming a keyed receiver in the inner circumferential surface of the first portion; and press-fitting an insert into a counterbore formed in the second planar surface, the insert including one planar surface abutting the keyed receiver bore and another planar surface flush with the second planar surface, the insert having an aperture formed therethrough, the aperture having a diameter less than the first diameter.

The foregoing and other aspects will become apparent from the following detailed description of the invention when considered in conjunction with the accompanying drawing figures. It is to be expressly understood, however, that the figures are not intended as a definition of the invention, but are for the purpose of illustration only.

BRIEF DESCRIPTION OF THE DRAWING FIGURES

DETAILED DESCRIPTION OF THE INVENTION

Figure 2:
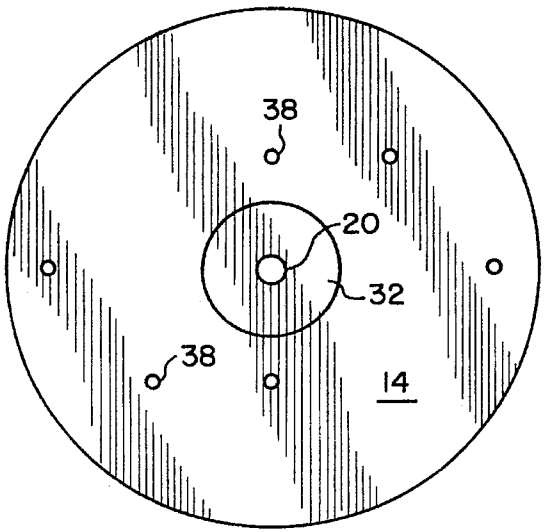
FIG. 2 is a view of the servo-wheel of FIG. 1 showing an opposed planar surface.
Figure 3:
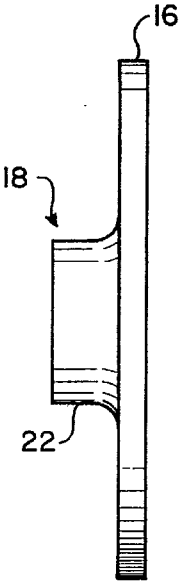
FIG. 3 is a view taken along line 3—3 of FIG. 1.
Figure 1:
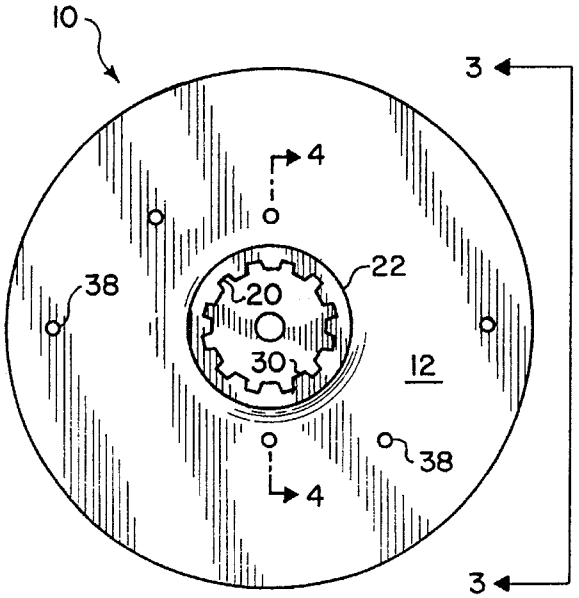
FIG. 1 is a view illustrating an embodiment of the servo-wheel of the present invention showing one of the planar surfaces.
Figure 4:
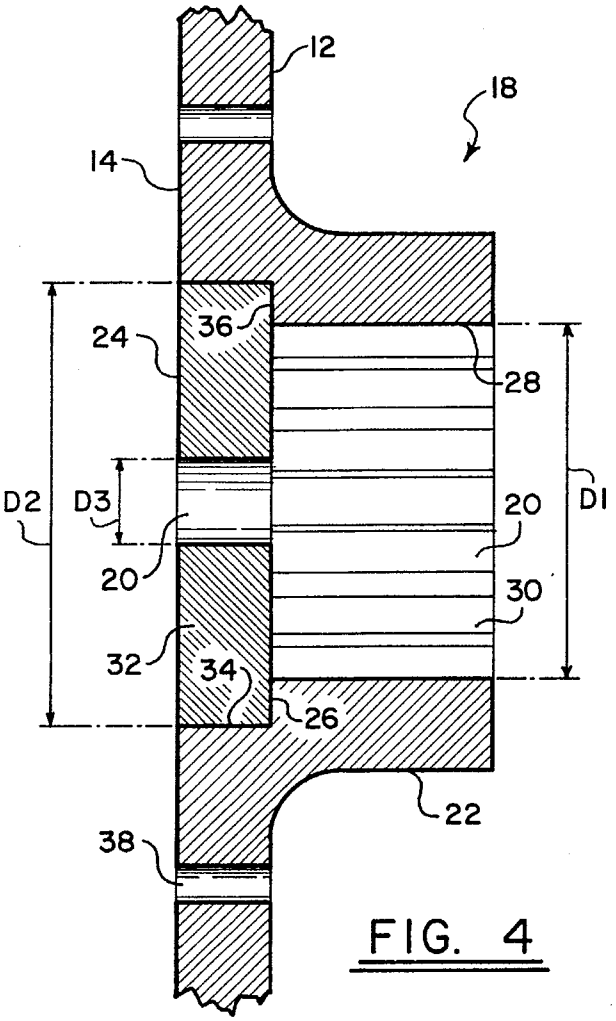
FIG. 4 is an enlarged partial cross-sectional view taken along line 4—4 of FIG. 1.

The servo-wheel of FIGS. 1–3 is generally designated 10 and is a rigid disc-shaped body, preferably cut from aluminum bar stock, having a planar surface 12, an opposed planar surface 14 and an outer circumferential surface 16. A hub, generally designated 18, is located at the geometric center of wheel 10. A bore 20 extends through wheel 10. A raised portion 22 is machined to protrude from planar surface 12 and forms a first part of hub 18. Raised portion 22 defines a first portion of bore 20 and includes an inner circumferential surface 28 having a diameter D1, see also FIG. 4.

A keyed receiver, such as a broached spline 30 is formed in the inner circumferential surface 28. An insert 32 is mounted by being press-fit into a counterbore 34 formed in planar surface 14. Counterbore 34 is coaxial with bore 20 and has a diameter D2, greater than D1 and also includes a bore seat 36 which is immediately adjacent spline 30. Insert 32 includes an aperture which defines a second portion of bore 20 having a diameter D3 which is less than D1. A surface 24 of insert 32 is flush-mounted with planar surface 14 of wheel 10, and another surface 26 of insert 32 is seated against seat 36 and abuts spline 30.

Figure 8:
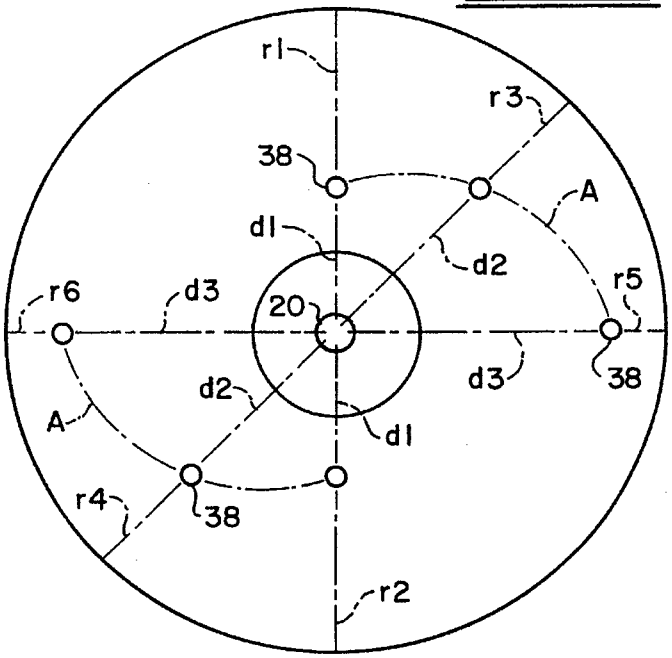
FIG. 8 is a diagrammatic view of the FIG. 2 embodiment further illustrating the array of mounting holes.

Wheel 10 includes at least one pair of mounting holes 38 formed therein. As illustrated in FIGS. 1, 2, and 8, a plurality of paired mounting holes can be provided for receiving control rods (discussed later). One of the holes 38 of a first pair is positioned on radius r1 at a distance d1 from the center of bore 20, and the other of the holes 38 of the first pair is positioned on radius r2 at the distance d1, with r1 and r2 being 180° opposed. One of the holes 38 of a second pair is positioned on radius r3 at a distance d2 from the center of bore 20, and the other of the holes 38 of the second pair is positioned on radius r4 at the distance d2, with r3 and r4 being 180° opposed. Also, one of the holes of a third pair is positioned on radius r5 at a distance d3 from the center of bore 20, and the other of the holes 38 of the third pair is positioned on radius r6 at the distance d3, with r5 and r6 being 180° opposed. The distance d3 is greater than the distance d2, and the distance d2 is greater than the distance d1. Furthermore, the holes 38 are arrayed such that a line struck through the holes on either of r1, r3, r5 and r2, r4, r6, forms an arcuate line designated A in FIG. 8.

Figure 6:
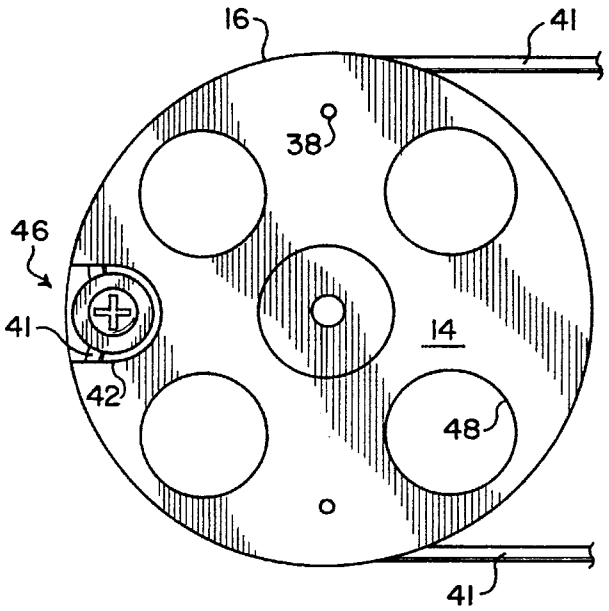
FIG. 6 is a view of the servo-wheel of FIG. 5 showing an opposed planar surface.
Figure 7:
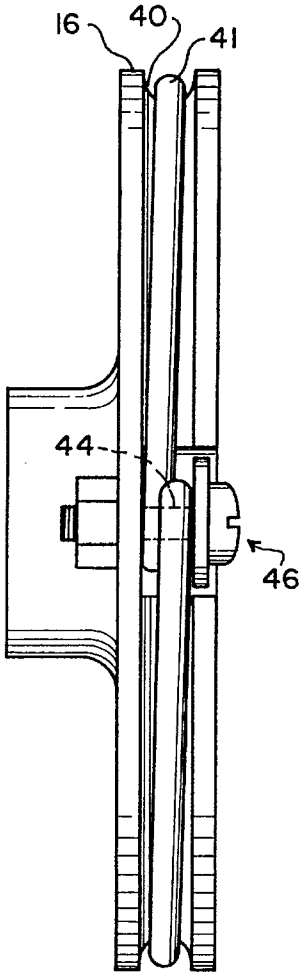
FIG. 7 is a view taken along line 7—7 of FIG. 5.
Figure 5:
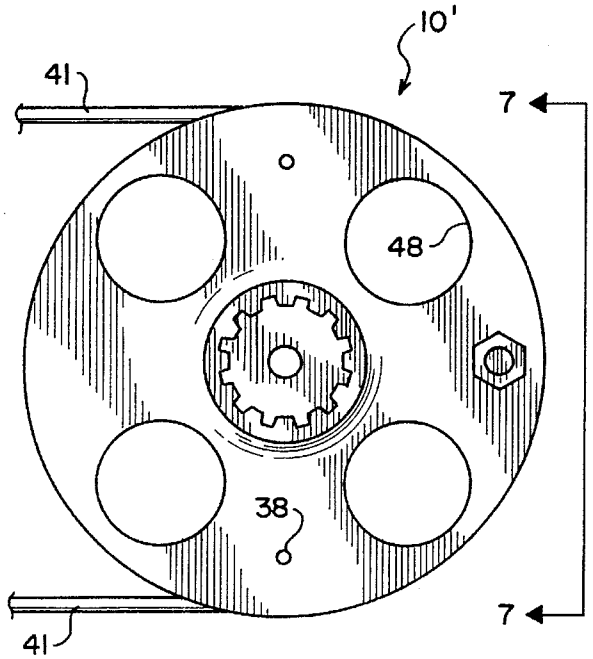
FIG. 5 is a view illustrating another embodiment of the servo-wheel of the present invention showing one of the planar surfaces.

In the embodiment of FIGS. 5, 6, and 7, wheel 10' includes a continuous groove 40 formed in outer circumferential surface 16, for receiving a control cable 41. Wheel 10' also includes a pair of control rod mounting holes 38 on radii which are 180° opposed and are equidistant from the center of bore 20 as described above. In this manner, wheel 10' can be used with either control rods or a control cable. Furthermore, planar surface 14 includes a relief 42 which is formed with outer circumferential surface 16 and exposes a portion of groove 40. An aperture 44 is formed through wheel 10' at the relief 42 for receiving fastening means such as a suitable bolt-washer-nut device 46. In this manner, the control cable 41 can be preferably looped around device 46 and clamped in position within groove 40 by the device 46 to limit slippage of cable 41. Also, a plurality of enlarged apertures 48 can be provided in wheel 10' in order to remove excess weight from the wheel if desired. This removal is usually done in enlarged versions of the servo-wheel of the present invention.

Figure 9:
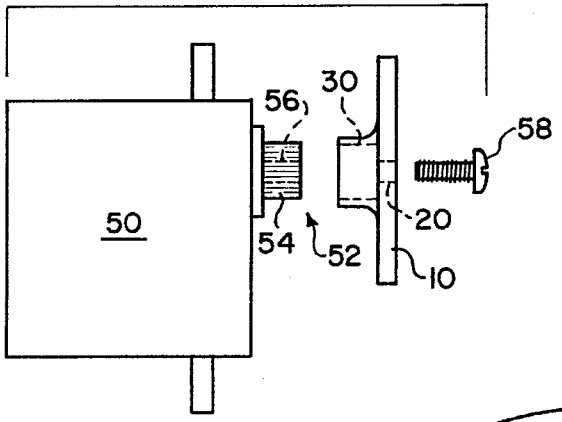
FIG. 9 is a view illustrating a typical servo-motor used in connection with the servo-wheel of the present invention.

In FIG. 9, a commercially available servo-motor 50 includes a plastic rotatable output shaft 52 having a male spline end 54 which is received by female spline 30 of servo-wheel 10 or 10'. A bore 56 formed in shaft 52 is self-tapping to receive a threaded fastener 58 which extends through bore 20 at insert 32.

Figure 10:
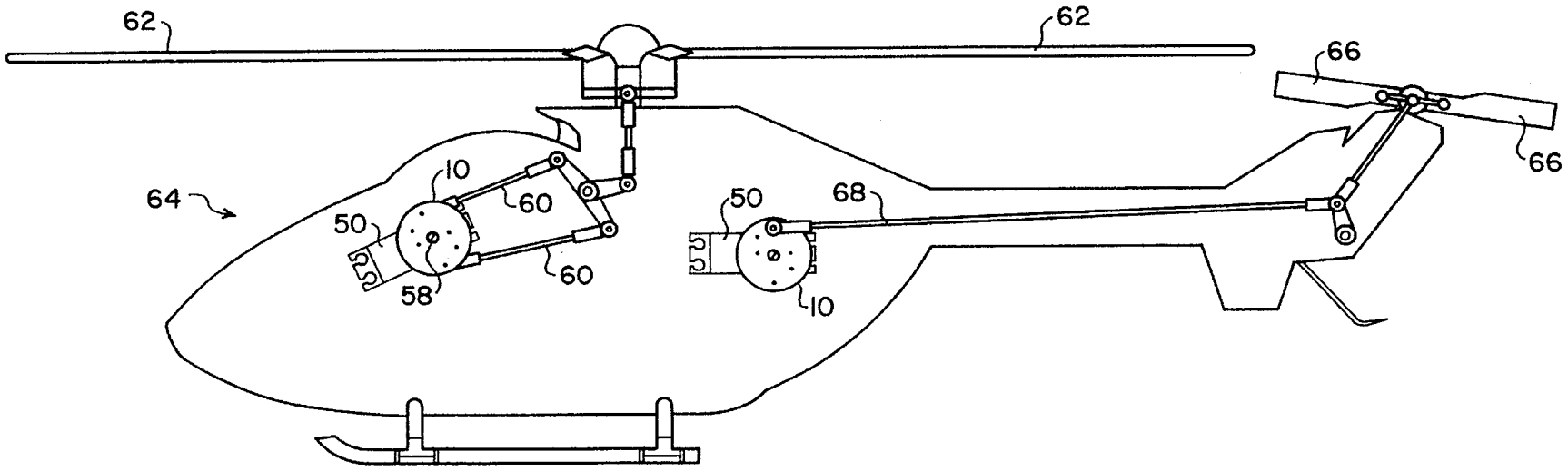
FIG. 10 is a diagrammatic view illustrating an operating environment for the servo-wheel of the present invention.

FIG. 10 diagrammatically illustrates use of wheel 10 connected to servo-motor 50 by fastener 58. A pair of connecting rods 60 received in holes 38 of wheel 10, transmit rotating motion of wheel 10 to main control members 62 of a model rotor craft 64. Also, another wheel 10 connected to another servo 50, similarly transmits rotating motion of wheel 10 to tail control members 66 via a connecting rod 68.

Figure 11:
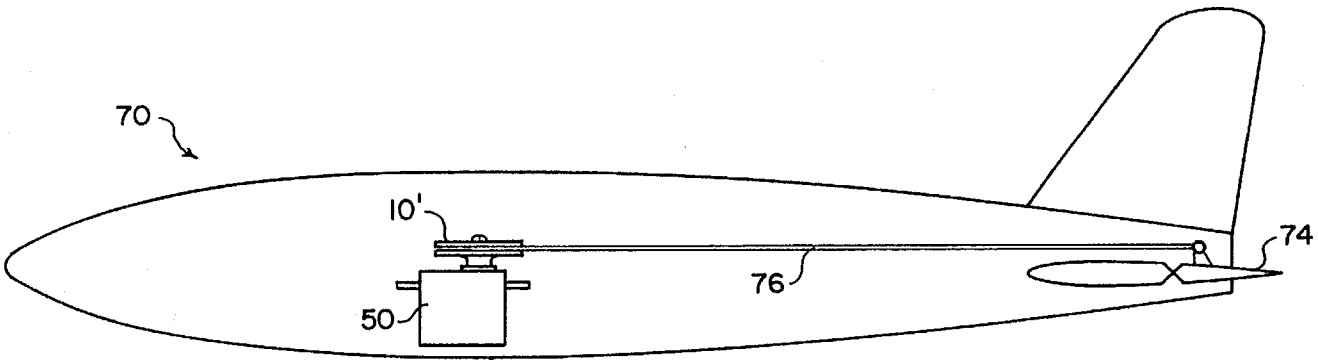
FIGS. 11 and 11*a* are diagrammatic views illustrating another operating environment for the servo-wheel of the present invention.
Figure 11A:
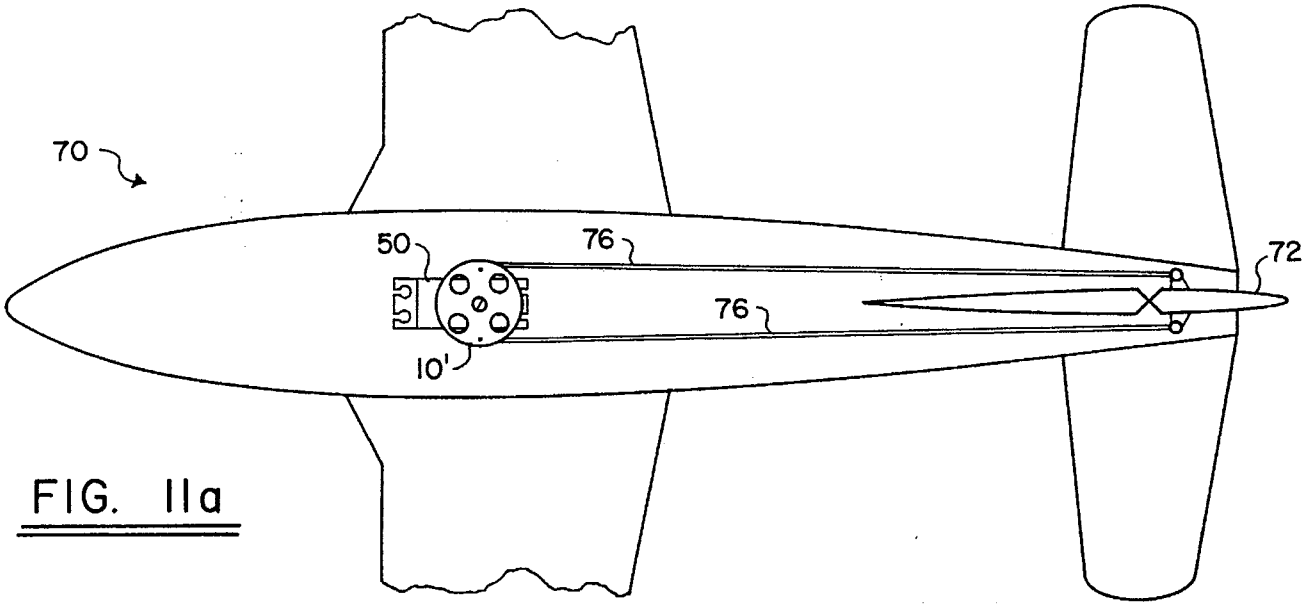

In another environment, diagrammatically illustrated in FIGS. 11 and 11*a*, fixed-wing aircraft 70 utilizes grooved wheels 10' connected for movement by servo-motors 50 to transmit rotating motion of wheels 10' to control members such as a rudder 72 and elevators 74 via cables 76 secured to wheels 10' in the manner described above.

When the servo-wheel is formed, various well known finishing procedures can be performed on the wheel such as facing, polishing, anodizing, and the like, to prepare the wheel for commercial use.

While this invention has been illustrated and described in accordance with a preferred embodiment, it is recognized that variations and changes may be made therein without departing from the invention as set forth in the claims.

Having described the invention, what is claimed is:

1. A servo-wheel comprising:

a rigid disc-shaped body having first and second opposed planar surfaces and an outer circumferential surface;

a hub at the geometric center of the body, the hub including a through-bore extending through the body, the through-bore having only a first part and a second part, the first part having a first diameter and being a keyed receiver, the second part having a second diameter greater than the first diameter and being a receiver adapted to receive a disc-shaped insert;

a disc-shaped insert mounted in the second part of the bore; the insert being a flat disc having the same diameter and axial depth as the second part of the bore; and the insert including an aperture formed therethrough, the aperture being coaxial with the first part of the bore.

2. The servo-wheel as defined in claim 1, wherein the insert includes a surface flush-mounted with the second planar surface.

3. The servo-wheel as defined in claim 1, wherein the body is metallic.

4. The servo-wheel as defined in claim 1, wherein the outer circumferential surface of the body includes a continuous groove formed therein.

5. The servo-wheel as defined in claim 4, wherein one of the planar surfaces includes a relief formed therein, the relief being integratedly formed with the outer circumferential surface and the groove formed therein.

6. The servo-wheel as defined in claim 5, wherein the body includes an aperture formed therethrough at the relief and means in the aperture for securing a control cable which may be engaged in the groove.

7. The servo-wheel as defined in claim 1, wherein the body includes at least one pair of mounting holes formed therein, one of the holes being positioned on a first radius at a first radial distance from the hub, and the other of the holes being positioned on a second radius at the first radial distance from the hub, the first and second radii being 180° opposed.

8. The servo-wheel as defined in claim 1, wherein the body includes at least three pair of mounting holes formed therein, one of the holes of a first pair being positioned on a first radius at a first radial distance from the hub and the other of the holes of the first pair being positioned on a second radius at the first radial distance from the hub, the first and second radii being 180° opposed, one of the holes of the second pair being positioned on a third radius at a second radial distance from the hub and the other of the holes of the second pair being positioned on a fourth radius at the second radial distance from the hub, the third and fourth radii being 180° opposed and the second radial distance being greater than the first radial distance, and one of the holes of the third pair being positioned on a fifth radius at a third radial distance from the hub and the other of the holes of the third pair being positioned on a sixth radius at the third radial distance from the hub, the fifth and sixth radii being 180° opposed and the third radial distance being greater than the second radial distance.

9. The servo-wheel as defined in claim 8, wherein a line struck through the holes on either of the first, third and fifth radii and the second, fourth and sixth radii forms an arc.

10. The servo-wheel as defined in claim 1, wherein the keyed receiver is a spline which is broach-formed in the first part of the through-bore.

11. The servo-wheel as defined in claim 10, wherein the insert abuts the spline.

12. The servo-wheel as defined in claim 1, wherein the body includes a plurality of enlarged apertures formed therein, whereby excess weight is removed from the body.

13. For use in a control system for a model craft having a servo-motor and movable control members, a servo-wheel comprising:

a rigid disc-shaped body having first and second opposed planar surfaces and an outer circumferential surface;

a hub at the geometric center of the body, the hub including a through-bore formed therein extending from the first planar surface to the second planar surface, the through-bore having only a first part and a second part, the first part having a first diameter and being a keyed receiver, the second part having a second diameter greater than the first diameter and being a receiver adapted to receive a disc-shaped insert;

a disc-shaped insert mounted in the second part of the bore, the insert being a flat disc having the same diameter and axial depth as the second part of the bore;

the insert including an aperture formed therethrough, the aperture being coaxial with the first part of the bore;

a keyed driver received at a first end by the keyed receiver, the keyed driver rotatably connected to the servo-motor at a second end, whereby the servo-wheel is rotatably moved by the servo-motor; and means interconnecting the servo-wheel and the control members for transmitting the movement of the servo-wheel to the control members.

14. The system as defined in claim 13, wherein the insert includes a surface flush-mounted with the second planar surface.

15. The system as defined in claim 13, wherein the body is metallic.

16. The system as defined in claim 13, wherein the outer circumferential surface of the body includes a continuous groove formed therein.

17. The system as defined in claim 13, wherein the keyed receiver is a spline which is broach formed in the first part of the through-bore.

* * * * *